US006601844B2

(12) United States Patent
Ballestrazzi et al.

(10) Patent No.: US 6,601,844 B2
(45) Date of Patent: Aug. 5, 2003

(54) PROCEDURE FOR FEEDING PRODUCTS IN SHEET FORM TO A CONVEYOR AND PICK UP UNIT

(75) Inventors: Aris Ballestrazzi, Savignano sul Panaro (IT); Lamberto Tassi, Savignano sul Panaro (IT)

(73) Assignee: Sitma S.p.A., Spilamberto (IT)

( * ) Notice: Subject to any disclaimer, the term of this patent is extended or adjusted under 35 U.S.C. 154(b) by 0 days.

(21) Appl. No.: 09/858,570

(22) Filed: May 17, 2001

(65) Prior Publication Data

US 2001/0052668 A1 Dec. 20, 2001

(30) Foreign Application Priority Data

May 29, 2000 (IT) ..... MI00A 1183

(51) Int. Cl.[7] ..... B65H 3/08; B65H 5/02
(52) U.S. Cl. ..... 271/100; 271/102
(58) Field of Search ..... 271/11, 100, 102, 271/107, 277, 82

(56) References Cited

U.S. PATENT DOCUMENTS 3,650,525 A * 3/1972 Hageman et al. ..... 271/101
3,768,804 A * 10/1973 Swanson ..... 271/101
3,810,612 A * 5/1974 McCahon et al. ..... 271/11
4,198,039 A * 4/1980 Bryson et al. ..... 270/52.29
4,358,100 A * 11/1982 Muller ..... 101/409
4,768,770 A * 9/1988 Pessina et al. ..... 270/52.14
5,100,118 A * 3/1992 Hobbs et al. ..... 270/52.17
5,174,559 A * 12/1992 Diamantides ..... 271/100
5,613,670 A * 3/1997 Ballestrazzi et al. ..... 270/58.29
5,833,229 A * 11/1998 Prim ..... 271/10.03
6,015,145 A * 1/2000 Hartel ..... 270/52.2
6,070,866 A * 6/2000 Wepfer ..... 271/10.11
6,193,229 B1 * 2/2001 Hall et al. ..... 271/10.01

FOREIGN PATENT DOCUMENTS

EP 0620174 10/1994
GB 1 140 495 1/1969

* cited by examiner

*Primary Examiner*—Donald P. Walsh
*Assistant Examiner*—Joseph Rodriguez
(74) *Attorney, Agent, or Firm*—Oblon, Spivak, McClelland, Maier & Neustadt, P.C.

(57) ABSTRACT

A procedure for feeding products in sheet form to a conveyor by at least one sheet feeder with a pile of products in sheet form on a loading table includes the following phases. At least one sheet feeder is placed with a free edge of its loading table for the pile of products in sheet form inclined at an angle in relation to a direction parallel to a principal feed axis coinciding with the axis of the conveyor. A pile of products in sheet form is prepared to be placed on the loading table. The pile of products in sheet form is placed with a flat surface of these, provided with ribbing, inclined at an angle in relation to a pick-up assembly of at least one sheet feeder so that one corner or vertex of the products is placed projecting beyond the end edge of the loading table. A pick-up assembly in a sheet feeder uses this procedure.

11 Claims, 5 Drawing Sheets

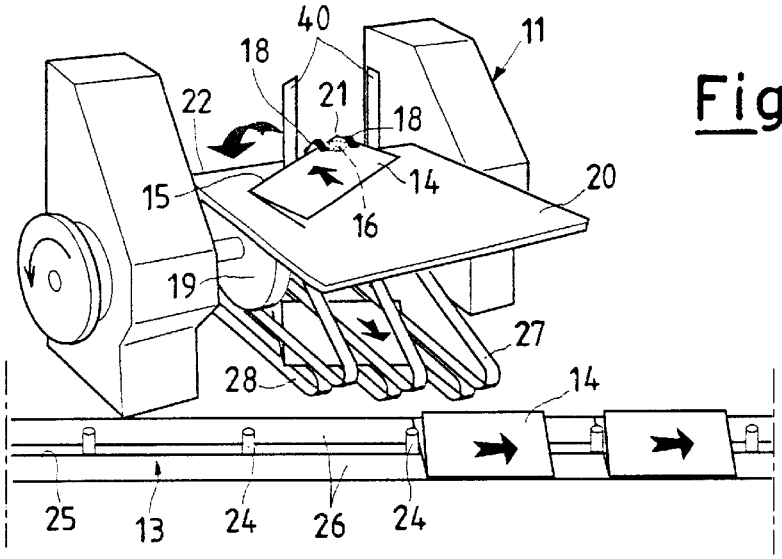
Fig.1
Fig.2
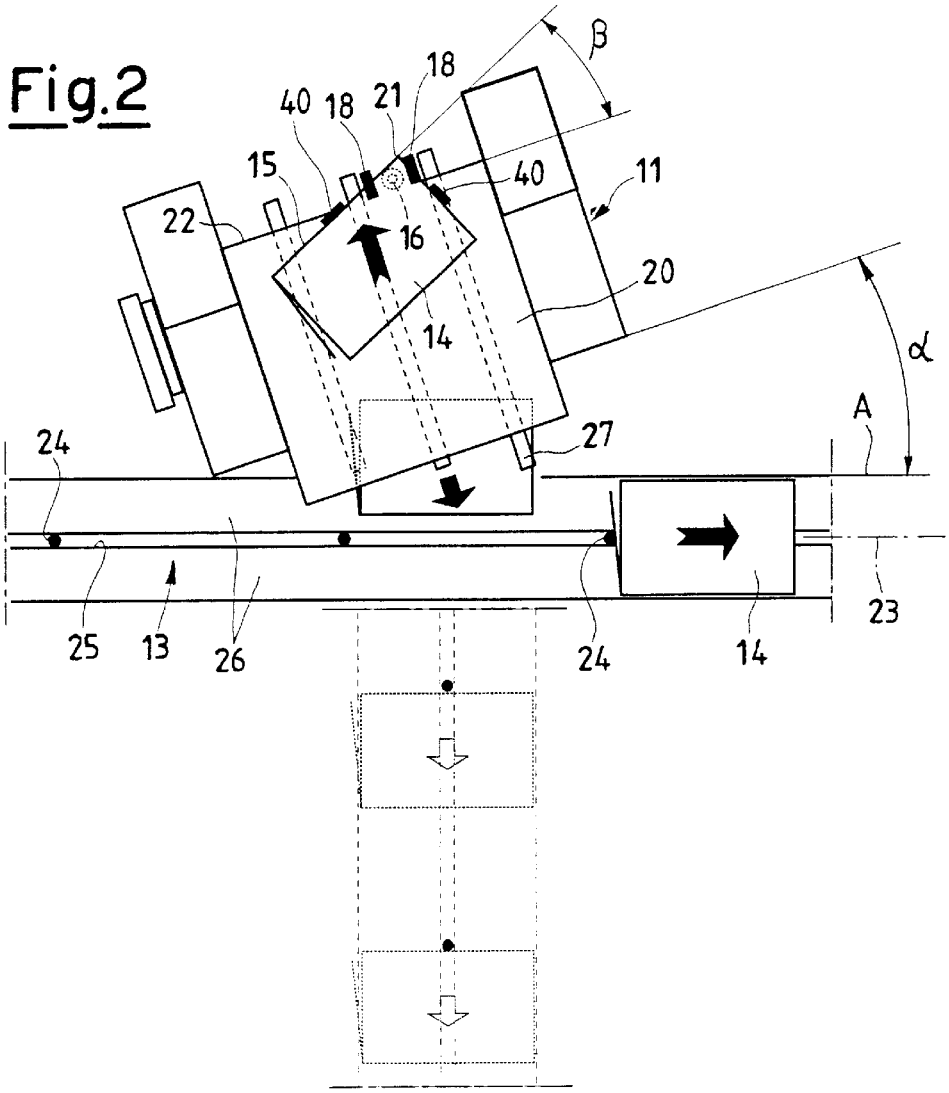

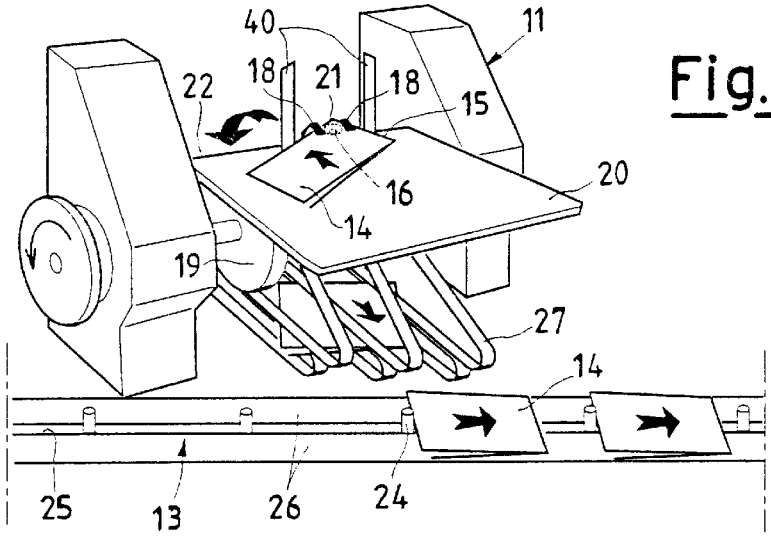
Fig.6
Fig.7
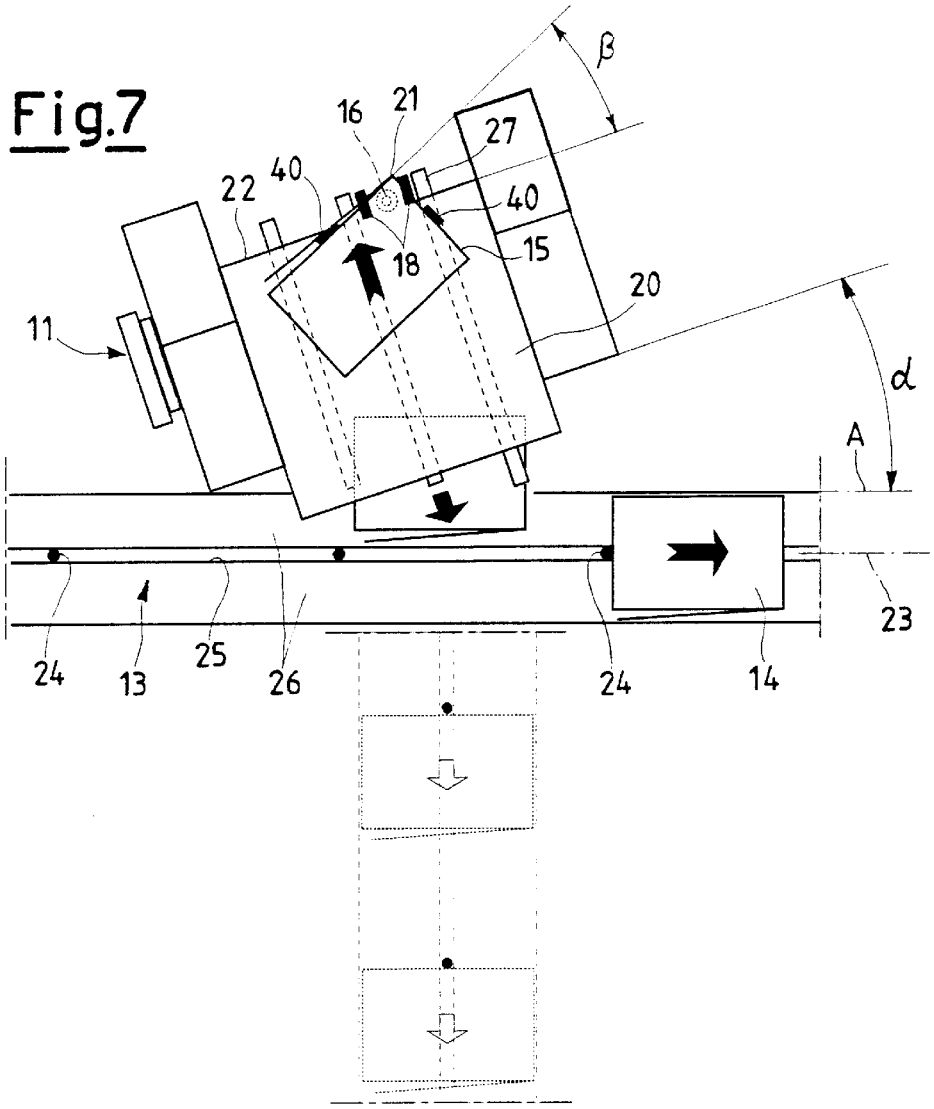

PROCEDURE FOR FEEDING PRODUCTS IN SHEET FORM TO A CONVEYOR AND PICK UP UNIT

BACKGROUND OF THE INVENTION

1. Field of the Invention

The present invention relates to a procedure for feeding products in sheet form to a conveyor, in particular associated with an apparatus for packaging, and with a pick-up assembly in a sheet feeder that uses this procedure.

2. Discussion of the Background

In the field of the selection and transport products in sheet form, in particular in machines associated with packaging apparatus, there may be problems in correct and aligned feed of the products in sheet form, such as inserts, additional sheets, publishing products in general. In fact, these products usually require to be fed to a conveyor for collection and feed towards stations or machines for subsequent packaging and must be perfectly aligned over the underlying product.

In order not to create packaging problems and give the finished package, comprising the additional elements, a pleasing appearance, feed of single products in sheet form must be performed according to a direction well aligned and parallel to the one of the final position that must be obtained.

Moreover, it must be taken into account that to obtain a good grasp on the additional product it must e possible to grasp the product itself in an area with a certain amount of rigidity. This is also important in order for the product to be extracted without being broken and to avoid "tearing" of part of the product, which means it cannot be picked up by the suction cups.

Moreover, the current system for picking up and feeding the material in sheet form requires the transverse or longitudinal crease of the material in sheet form to be correctly aligned with the other publishing material to which it is to be added. Moreover, the insert or additional sheet must be correctly aligned with the pick-up area to enable it to be grasped correctly by the feeder or sheet feeder. For this purpose the feeder or sheet feeder is positioned laterally or astride the conveyor so that the insert can be grasped along the crease or the rigid area of this to be grasped correctly, as mentioned above.

The machine operator must then proceed, once the series of products and/or inserts to add on top of one another for subsequent packaging is known, to arrange the various sheet feeders according to the positions required depending on the crease of the particular insert and depending on the final position to be obtained in the package. This operation causes a loss of time to move the sheet feeder to the correct position.

SUMMARY OF THE INVENTION

The object of the present invention is to find a solution to these problems, by feeding products in sheet form towards a conveyor, in particular for example associated with a packaging apparatus, which generally consents feed of a generic insert, whatever the position (longitudinal or transverse) of its rigid or creased part.

This object according to the present invention is achieved by performing a procedure to feed products in sheet form to a conveyor, in particular associated with a packaging apparatus, and a pick-up assembly in a sheet feeder that uses this procedure, according to what is set down in the independent claims.

Other characteristics emerge from the subsequent appended claims.

BRIEF DESCRIPTION OF THE DRAWINGS

The characteristics and advantages of a procedure for feeding products in sheet form to a conveyor, in particular associated with a packaging apparatus, and a pick-up assembly in a sheet feeder that uses this procedure according to the present invention shall become clearer from the description below, given as a purely exemplary and non-limiting example, referring to the appended schematic drawings, in which:

FIG. 1 is a perspective view of a sheet feeder positioned according to the present invention which grasps a product with longitudinal rib, FIG. 2 is a top plan view of the sheet feeder in FIG. 1, FIG. 6 is a perspective view of a sheet feeder positioned according to the present invention that grasps a product with transverse rib, FIG. 7 is a top plan view of the sheet feeder in FIG. 6.

DESCRIPTION OF THE PREFERRED EMBODIMENTS

Figure 3:
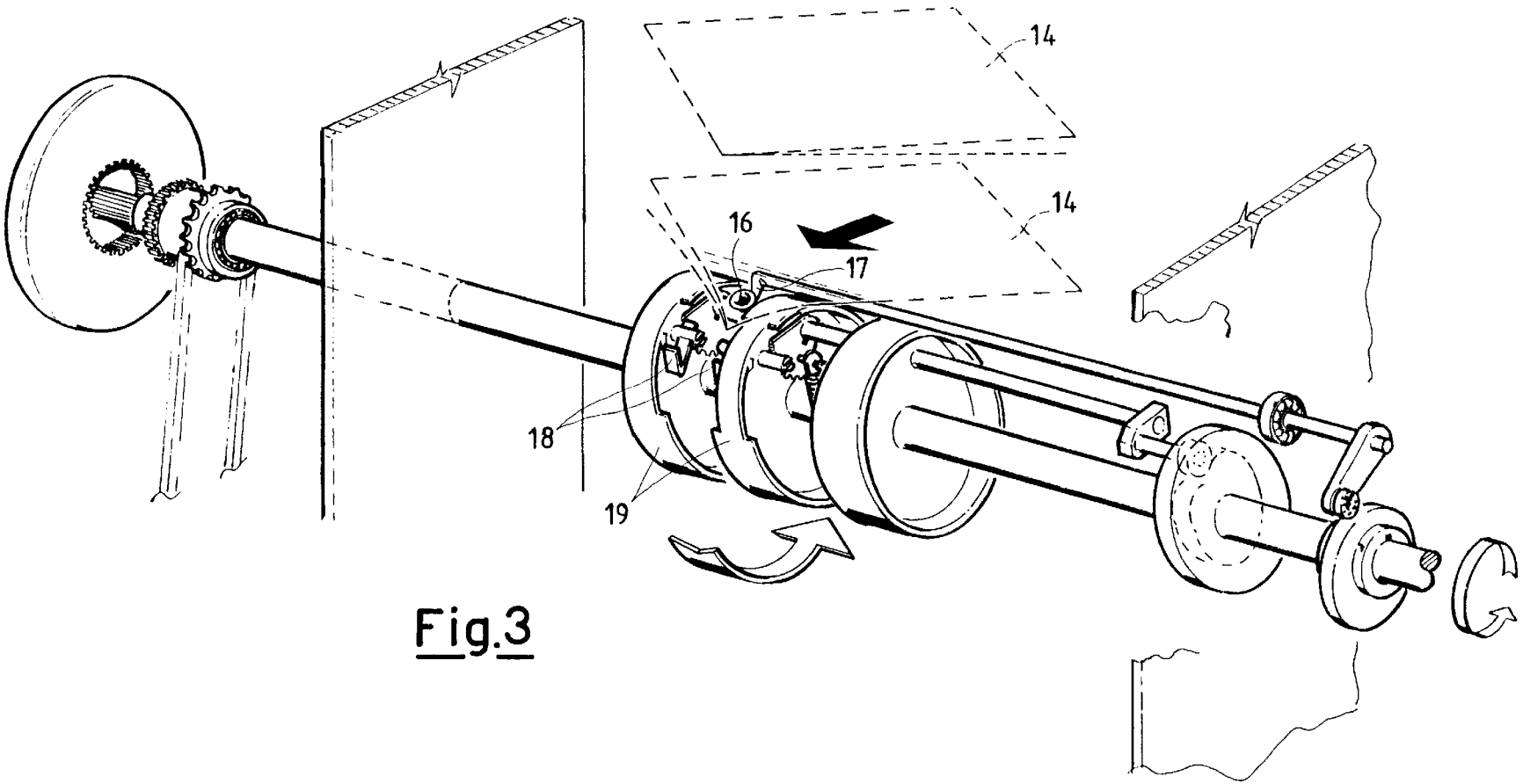
FIG. 3 is a schematic view of an internal part of a grasping device with publishing product or insert being grasped, of the type shown in FIG. 1, indicated with broken lines.

The figures in general schematically show a sheet feeder, namely a feeding device for single products in sheet form 11 by means of which the single products 14 are extracted from the bottom of a pile 12 and fed towards a conveyor 13, in particular associated with a packaging apparatus, not shown.

It must firstly be stated that each product in sheet form 14 included in the pile 12 in general has a rib or ribbing 15 produced by folding its two panels. The products 14 are stacked and held in place by vertical guides 40, which allow pick-up by the suction cup and extraction of the last product at the bottom of the pile 12. This rib or ribbing 15 can be provided in a larger direction (longitudinal) or smaller direction (transverse) of the final product 14. In this way the product 14 has a portion provided with greater rigidity where it is normally grasped by an element designed for this operation, such as a suction cup 16 positioned on a up-and-over arm 17 and/or a clamp 18 associated with a specific clamp-bearing wheel 19 or an oscillating roller 30.

According to the present invention, the sheet feeder 11 is first positioned with a free edge 22 of its loading table 20 inclined according to an angle a in relation to a direction A parallel to a principal feed axis 23 which is an axis coinciding with the axis of the conveyor 13.

After this first phase to position the sheet feeder 11, a second phase prepares a pile 12 of products in sheet form 14 to place on a loading table 20 of a sheet feeder or similar device. The subsequent phase is a phase to place this pile 12 of products in sheet form 14 with a straight surface of these, provided with ribbing 15, according to a direction inclined to an angle β in relation to a pick-up assembly, for example the suction cup 16 and the clamp 18. More precisely, the pile 12 of products must be positioned so that one corner or vertex 21 of these products 14 is taken towards the end edge 22 of the loading table 20 of the 15 sheet feeder 11 or similar device. The ribbing 15 is also inclined to an angle β in relation to the end edge 22 of the loading table 20.

It is therefore essential to have previously inclined the sheet feeder 11 to the angle a in relation to the principal feed direction 23, coinciding with the direction of the conveyor 13. This conveyor 13 is usually a conveyor with pushers 24 which slide step by step inside a longitudinal slot 25 in a sliding table 26.

In this way, the sheet feeder 11 can be installed to the side of the conveyor line 13 of the products 14 fed step by step. By means of an element to vary the position of the product in motion, the sheet feeder 11, varies the position of the product in sheet form 14 conveyed, bringing it parallel to the direction of feed of the conveyor 13 with a minimum angle of variation.

The FIGS. 1–3 and 6–7 show how it is uninfluential on the procedure of the present invention whether the product to be fed has a rib or ribbing 15 provided according to a larger longitudinal direction or a smaller transverse direction. In fact, in both cases a safe grasp is obtained on the corner or vertex 21 of these products 14, thanks to this arrangement.

Moreover, the pick-up elements are reduced as only one suction cup is required to separate and convey, on the wheels bearing the clamp or the roller, the vertex of the product to be extracted from those stacked on the loading table or magazine.

Advantageously, there are no cantilever products during the phases to extract the bottom product from the pile; this is obtained thanks to the inclination of the cantilever product in relation to the end edge 22 of the loading table 20. This eliminates specific devices to support the cantilever surfaces of the product, such as points, pins or moving serrations, that were required and damaged the product to some extent during extraction from the bottom of the pile. Moreover, it must be mentioned that these devices were not capable of guaranteeing secure support to the product.

Grasping of the corner or vertex 21 of the product is possible as this corner, no matter what type of ribbing the product has, gives the grasped product a certain amount of rigidity.

According to the present invention a product in sheet form can consequently be fed towards the step by step conveyor, whether this product has longitudinal ribbing or transverse ribbing in relation to the direction of movement.

In this way, with the sheet feeder positioned in the same way it is even possible to feed in succession a product with longitudinal ribbing such as a magazine and a product with transverse ribbing such as a wall calendar.

In fact, in both cases the longitudinal or transverse ribbing, by providing a rigid area in the part of the product being grasped (corner or vertex), contributes towards self-support of the product, also preventing more than one product from being grasped from the bottom of the pile.

FIG. 3 shows how in a device that uses this method only one suction cup 16 is fitted between a single pair of clamps 18 positioned on relevant wheels 19.

Figure 4:
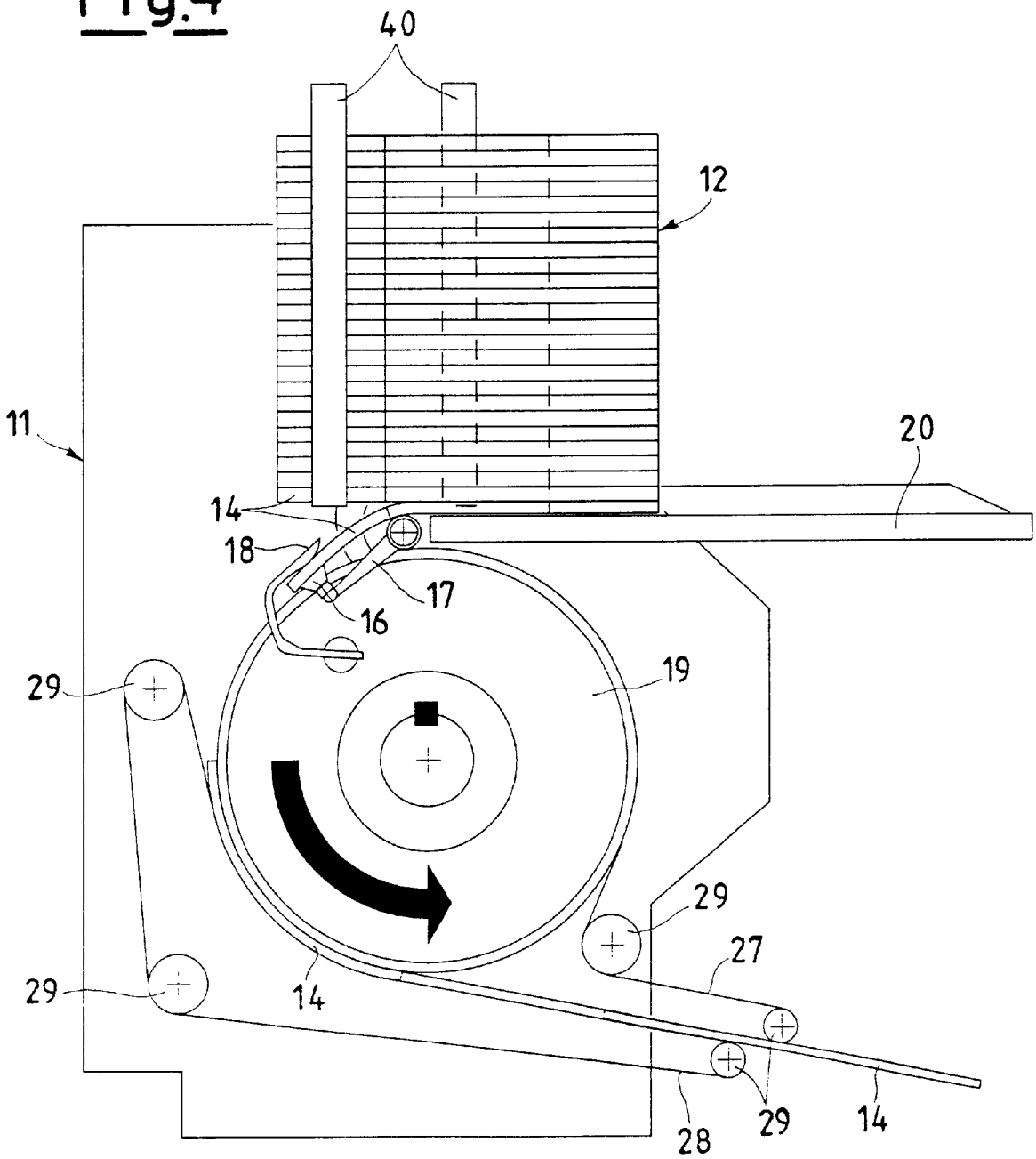
FIG. 4 shows a side elevation view of a device according to FIG. 1 with overturning of the picked up product.

FIG. 4 shows the route of single products 14 along the wheels 19 with the aid of guide belts 27 and 28, ring-wound on transmission wheels 29 and which lock the product between them to feed it overturned to the conveyor 13 positioned at the side.

Figure 5:
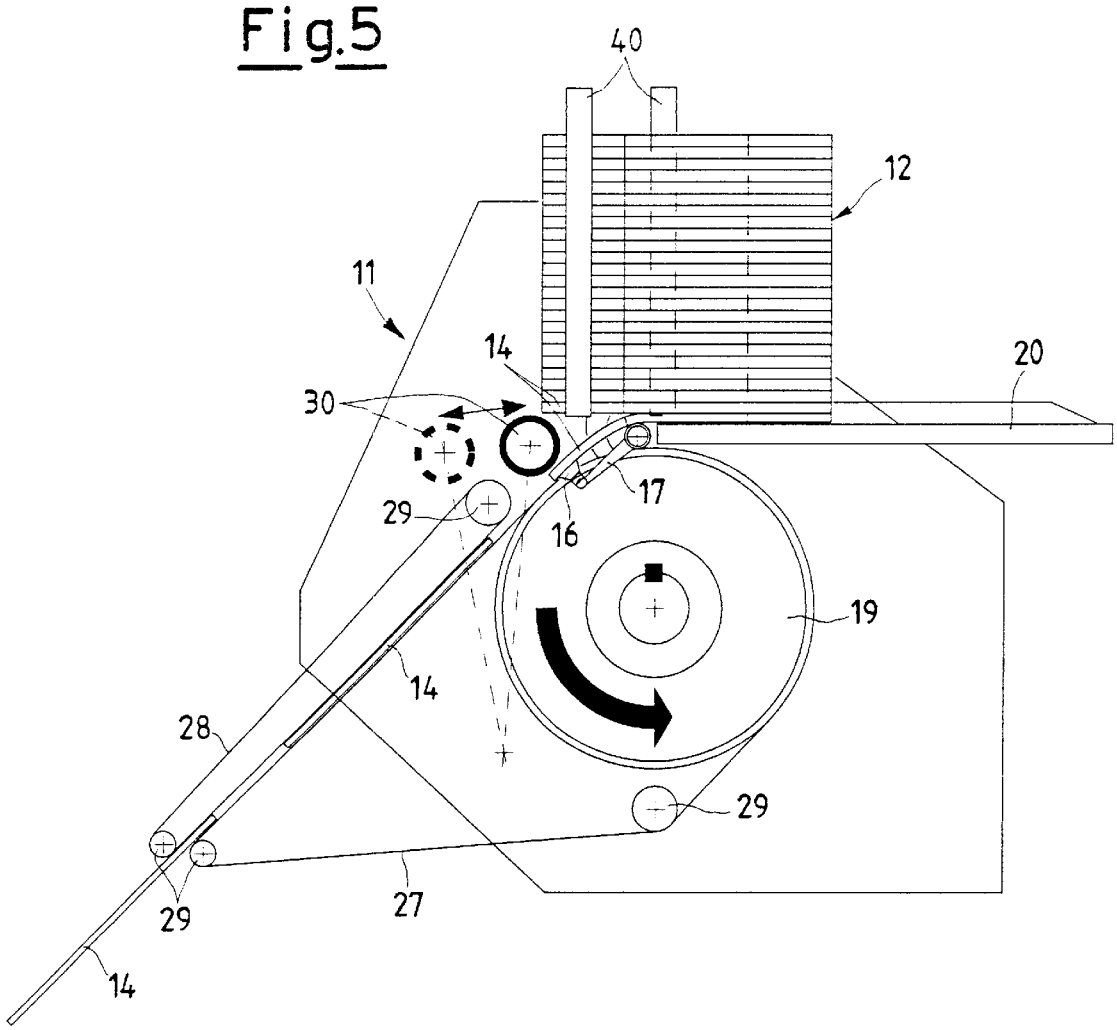
FIG. 5 shows a side elevation view of a device fed according to the present invention without overturning of the product fed to the conveyor.

FIG. 5 shows the route of a single product 14 extracted from the bottom of the pile 12 along a small portion of the wheels 19, in this case the product 14 being fed directly after being extracted from the bottom of the pile towards the conveyor positioned at the side. In this case the single products 14 are fed to the conveyor 13 which is positioned at the side thanks to the cooperation of the guide belts 27 and 28, associated with the wheels 19, and the presence of an oscillating roller 30.

Both FIG. 2 and FIG. 7 show how the conveyor 13 can be realized with travel essentially parallel to the travel of the sheet feeder or even perpendicular to this. In both cases, the free edge 22 of the loading table 20 is inclined according to an angle α and respectively (90°–α) in relation to said principal feed axis 23 which coincides with the axis of the conveyor 13. In this way feed is also implemented in favour of the sense of feed of the conveyor, in addition to optimum and simple grasping of the single product in sheet form from the pile positioned on the sheet feeder.

What is claimed is:

1. A process for feeding products in sheet form to a conveyor by at least one sheet feeder bearing a pile of products in sheet form on a loading table, comprising:

placing the at least one sheet feeder with a free end edge of the loading table inclined at a non-zero first angle in relation to a direction parallel to a principal feed axis coinciding with an axis of the conveyor;

preparing the pile of products in sheet form on the loading table;

placing the pile of products in sheet form with a flat surface provided with ribbing, at a direction inclined at a non-zero second angle in relation to a pick-up assembly of the at least one sheet feeder so that one corner or vertex of the products is positioned projecting beyond the free end edge of the loading table, wherein the free end edge of the loading table is a back edge of the loading table furthest away from the conveyor.

2. Procedure as claimed in claim 1, wherein the pick-up unit has only one suction cup and at least one clamp to grasp and extract the one comer or vertex of the products.

3. Procedure as claimed in claim 1, wherein the pick-up unit has only one suction cup and at least one roller to grasp and extract the one comer or vertex of the products.

4. Procedure as claimed in claim 1, wherein the pick-up unit feeds the conveyor overturning one of the products in sheet form taken from a bottom of the pile of products in sheet form on the loading table.

5. Procedure as claimed in claim 1, wherein the pick-up unit feeds the conveyor directly with one of the products in sheet form taken from a bottom of the pile of products in sheet form on the loading table.

6. A system for feeding products in sheet form to a conveyor, comprising:

at least one sheet feeder bearing a pile of products in sheet form on a loading table, wherein the at least one sheet feeder includes a free end edge of its loading table for the pile of products in sheet form inclined a non-zero first angle in relation to a direction parallel to a principal feed axis coinciding with an axis of the conveyor;

wherein the pile of products in sheet form is configured to be placed on the loading table with a flat surface provided with ribbing, at a direction inclined at a non-zero second angle in relation to a pick-up assembly of the at least one sheet feeder so that one corner or vertex of the products is positioned projecting beyond the free end edge of the loading table, wherein the free end edge of the loading table is a back edge of the loading table farthest away from the conveyor.

7. A system of claim 6, further comprising:

only a single suction cup positioned under the free end edge of the loading table and movable to engage with the corner or vertex of the products to grasp and feed one of the products in sheet form extracted from a bottom of the pile of products in sheet form towards the conveyor.

8. A system as claimed in claim 7, further comprising, downstream from the single suction cup, at least one clamp fitted on a clamp-bearing wheel to receive the corner or vertex and to lock the corner or vertex on the clamp-bearing wheel before unloading the one of the products in sheet form onto the conveyor.

9. A system as claimed in claim 8, further comprising, in cooperation with the single suction cup and the one clamp-bearing wheel bearing a clamp, at least one pair of guide belts ring-wound on transmission wheels and on a clamp-bearing wheel, which lock each extracted product between them to feed each extracted product overturned to the conveyor positioned at a side.

10. A system as claimed in claim 7, further comprising, downstream of the single suction cup, at least one roller configure to grasp the corner or vertex and to extract the corner or vertex before unloading the corner or vertex, onto the conveyor.

11. A system as claimed in claim 7, further comprising, in cooperation with the single suction cup and the roller, at least one pair of guide belts ring-wound on transmission wheels, which lock each product between them to feed each product overturned to the conveyor positioned at a side.

* * * * *